United States Patent [19]

Takahashi et al.

[11] Patent Number: 4,752,002

[45] Date of Patent: Jun. 21, 1988

[54] CONTINUOUS PACKAGE TRAIN OF DEOXIDIZING AGENT

[75] Inventors: Hideyuki Takahashi; Takehiko Moriya, both of Tokyo, Japan

[73] Assignee: Mitsubishi Gas Chemical Company, Inc., Japan

[21] Appl. No.: 941,331

[22] Filed: Dec. 15, 1986

[30] Foreign Application Priority Data

Dec. 18, 1985 [JP] Japan ..... 60-283073
Nov. 17, 1986 [JP] Japan ..... 61-273387

[51] Int. Cl.[4] ..... B65D 81/26

[52] U.S. Cl. ..... 206/204; 206/390; 206/524.1

[58] Field of Search ..... 206/390, 410, 524.4, 206/204, 484.1, 484.2; 383/37

[56] References Cited

U.S. PATENT DOCUMENTS

| | | | |
|---|---|---|---|
| 494,907 | 4/1893 | Turner | 206/390 X |
| 1,295,141 | 2/1919 | Elliott | 206/347 X |
| 3,189,227 | 6/1965 | Hobbs et al. | 206/390 X |
| 3,396,835 | 8/1968 | Boutonnet | 206/410 |
| 3,751,875 | 8/1973 | Membrino | 383/37 X |
| 3,850,294 | 11/1974 | Philipps et al. | 206/410 X |
| 4,100,681 | 7/1978 | Hollander | 206/484 X |
| 4,406,370 | 9/1983 | Gaisser et al. | 206/484 |
| 4,579,223 | 4/1986 | Otsuka et al. | 206/204 |
| 4,657,133 | 4/1987 | Komatsu et al. | 206/204 |

FOREIGN PATENT DOCUMENTS

| | | | |
|---|---|---|---|
| 55-5362 | 1/1980 | Japan . | |
| 55-7121 | 1/1980 | Japan . | |
| 92538 | 7/1981 | Japan | 206/524.4 |
| 58-26322 | 6/1983 | Japan . | |
| 32113 | 7/1983 | Japan | 206/524.4 |
| 58-33052 | 7/1983 | Japan . | |
| 59-18254 | 4/1984 | Japan . | |
| 59-18255 | 4/1984 | Japan . | |
| 59-11054 | 4/1984 | Japan . | |
| 2091 | of 1912 | United Kingdom | 206/390 |

*Primary Examiner*—William Price
*Attorney, Agent, or Firm*—Leydig, Voit & Mayer

[57] ABSTRACT

A belt-like package train having at least a surface layer made of a plastic includes a plurality of packages connected in series in one direction, each package being charged with a dioxidizing agent such as a metal powder, e.g., iron powder. The package train is coiled on a core made of a thick paper material having a small air-permeability. The coiled package train is disposed on the inlet side of an automatic severing apparatus and is successively fed into the apparatus so that the packages are successively severed from the outermost layer and then from the inner layers of the coiled package train.

3 Claims, 2 Drawing Sheets

PRIOR ART

CONTINUOUS PACKAGE TRAIN OF DEOXIDIZING AGENT

BACKGROUND OF THE INVENTION

1. Field of the Invention

The present invention relates to a continuous package train having a plurality of packages connected in series at least in one direction in a belt-like form, each package containing a deoxidizing agent. The invention also is concerned with an apparatus for severing the packages of deoxidizing agent from such a train of packages.

2. Description of the Related Art

In order to prevent goods such as foodstuffs and medical drugs from being deteriorated during long storage, it has been proposed to put a package of an agent capable of absorbing oxygen (referred to as deoxidizing agent, hereinunder) in a hermetic foodstuffs or drug container such as a sack or a can having walls of a high gas barrier effect. This measure has became an established technique particularly in the field of preservation of foodstuffs, and is finding spreading use in various fields which require elimination of all kinds of unfavorable effect which may be caused by the presence of oxygen.

Systems are also proposed for automatically producing goods such as foodstuffs and medical drugs sealed in hermetic containers together with packages of a deoxidizing agent. For the purpose of achieving a high production efficiency, such production systems usually employ a package train of the deoxidizing agent in which a plurality of packages each containing the deoxidizing agent are connected in series in a form like a belt. The packages are severed one by one from the package train by an automatic severing apparatus and independent packages thus obtained are charged into successive containers of the goods.

FIG. 2 schematically shows the manner in which the packages are successively severed in a process for producing sealed goods. A package train generally denoted by 10 has a plurality of packages containing a deoxidizing agent and connected in series through sealed connecting webs. An automatic severing apparatus, which is generally designated by a reference numeral 12, has thickness sensors 14 which measure the thickness of the package train so as to distinguish the thin sealed connecting webs from the packages which are charged with the deoxidizing agent and, hence, are large in thickness. The apparatus 12 also has a cutter 16 which is operated in synchronism with the passage of the package train in accordance with the output from the thickness sensors 14 so as to cut the package train at successive sealed connecting webs, whereby the packages are severed one by one. The package train is folded at its connecting webs such that the successive packages are stacked on one another, and are stored in a case 18 with its trailing end placed on the bottom of the container such as to be continuously fed into the severing apparatus 12.

This known system, however, tends to suffer from a disadvantage in that the fold of the sealed connecting web cannot be perfectly straightened before it reaches the thickness sensors 14 of the automatic severing apparatus, with the result that the thickness sensor fails to detect the sealed connecting web so as to miss the timing for actuating the cutter 16. This problem is serious particularly in the case where the package has a layer of plastic film coating on the surface thereof. The same problem is encountered also when the detection of the sealed connecting web is effected by means of a photoelectric tube which can detect a specific mark on the package train. The use of a layer of plastic film coating on the package is disadvantageous also in that the package train cannot easily be folded at the sealed connecting webs due to a large resiliency exhibited by the plastic film, which makes it difficult to store a long package train in folded state.

Usually, a package of deoxidizing agent exhibits a tendency to absorb oxygen when left in the air, so that it is preferably kept away from the air unless it is not going to be charged in a container of goods such as foodstuffs. The known package train, when stored in a folded state, tends to allow the ambient air to flow into the spaces between adjacent packages stacked in layers, so that the packages undesirably absorb oxygen, with the result that the oxygen absorbability is impaired before the packages are severed by the severing apparatus.

The stored packages which have absorbed oxygen generate heat which is accumulated due to the high density of the stack of successive packages and in turn vaporizes the moisture inherently contained in the deoxidation agent so as to accelerate the impairment of its oxygen absorbability.

For these reasons, the length of the package train 10 which has to be fed to a severing apparatus is undesirably limited.

SUMMARY OF THE INVENTION

Accordingly, an object of the present invention is to provide a package train and a package severing apparatus which can overcome the above-described problems of the prior art.

More specifically, the present invention is aimed at providing a package train of a deoxidation agent and a package severing apparatus, capable of ensuring a high degree of precision of thickness measurement and minimizing any reduction in the oxygen absorbability of the packages in the stored state, thereby enabling the package train to have an increased length.

To this end, according to one aspect of the present invention, there is provided a continuous package train having a plurality of packages connected in series and charged with a deoxidizing agent, comprising: a belt-like body of the package train having a plurality of the packages connected in series at least in one direction; and a core on which the body of package train is coiled.

According to another aspect of the present invention, there is provided an apparatus for severing successive packages containing a deoxidizing agent from a continuous package train having the packages connected in series at least in one direction, so as to form independent packages successively, the apparatus comprising: cutting means for cutting the package train at connecting webs through which adjacent packages are connected; and the package-train supporting means disposed on the inlet side of the cutting means and adapted to rotatably hold a core on which the package train is coiled.

According to the invention, since the package train is rolled on a core, no fold is formed in the packages nor in the sealed connecting webs, so that a high degree of precision is obtained in the measurement of the thickness or photoelectric detection of marks. This in turn enables the package severing apparatus to cut the package train precisely at the connecting webs, thereby obviating the problems of the prior art.

In addition, since the package train is coiled in layers, only the outermost layer is exposed to the ambient air and the air cannot come into the space between adjacent layers, so that deterioration in the oxygen absorbability is advantageously avoided. The reduction in the oxygen absorbability is small even in the packages constituting the outermost layer of the coil, because only one side of the outermost layer is exposed to the ambient air.

The above and other objects, features and advantages of the present invention will become clear from the following description of the preferred embodiment when the same is read in conjunction with the accompanying drawings.

DESCRIPTION OF THE PREFERRED EMBODIMENT

Figure 3:
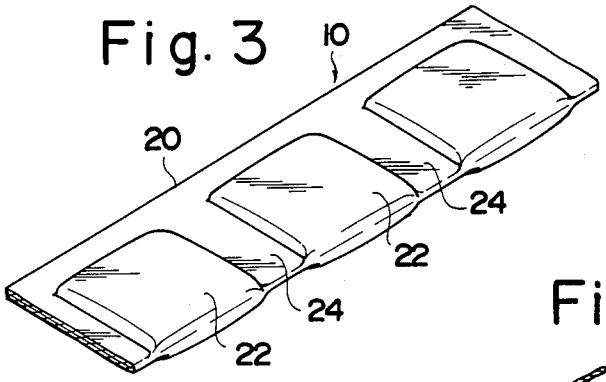
FIG. 3 is a perspective view of a continuous package train.

Referring to FIG. 3 which schematically shows a package train 10, a plurality of package units 20 are connected in series so as to form a train. More specifically, each package unit 20 has a sack portion 22 charged with a deoxidizing agent and a sealed connecting web 24. Thus, the sack portions 22 and the sealed connecting webs 24 are arranged alternatingly in the longitudinal direction of the package train 10. It will be understood that each sack portion 22 in this embodiment is sealed at its three sides after charged with the deoxidizing agent and the remaining side is constituted by an overturned edge of the package material.

Examples of the deoxidizing agent with which the package 22 is charged are: sulfite, hydrogen sulfite, dithionite, ferrous salt, hydroquinone, catechol, resorcin, pyrogallol, gallic acid, rongalit, ascorbic acid and/or its salt, isoascorbic acid and/or its salt, sorbose, glucose, lignin, dibutylhydroxytoluene, and butylhydroxyanisole. It is also possible to use a deoxidizing agent containing metallic powder such as iron powder or a deoxidizing agent of oxygen-gas generating type or carbon dioxide absorption type. Among these deoxidizing agents, ascorbic acid and/or its salt and deoxidizing agent containing metal powder such as iron powder are used most suitably.

Various types of packaging material are selectively used in accordance with the uses. For instance, a laminated sheet having a paper layer and a porous polyethylene film or a laminated sheet having a perforated plastic film, paper layer and a porous polyethylene film can be used suitably as the packaging material.

The package train in accordance with the present invention is stored in coiled state on a core such as a bobbin. This essentially requires that the packaging material has a high level of resistance to tension so that it may not be broken or torn when coiled. In addition, it is preferred that the packaging material is of the type which enables printing to be conducted on the reverse side thereof and that packaging material exhibits superior properties from the view point of safety and sanitation. To cope with such requirements, the packaging material preferably has a plastic film such as of polyethyleneterephthalate, polyamide, polypropylene, cellophane, and so forth.

Figure 4:
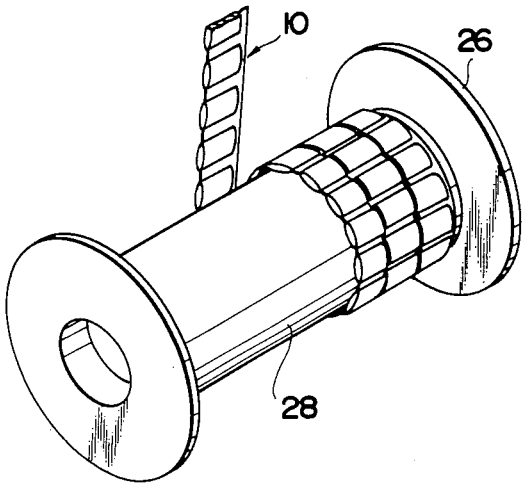
FIG. 4 is a perspective view of a package train coiled on a core.
Figure 5:
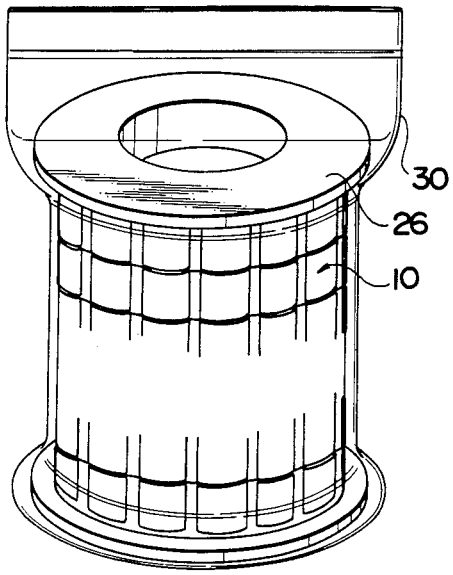
FIG. 5 is a perspective view of a wrapped package train.

The package train 10 thus formed is coiled on the core 28 of a bobbin 26 as shown in FIG. 4, and the coiled package train 10 is sealed in a sack 30 made of a film having a high level of gas barrier effect, before it is commercially distributed.

Figure 1:
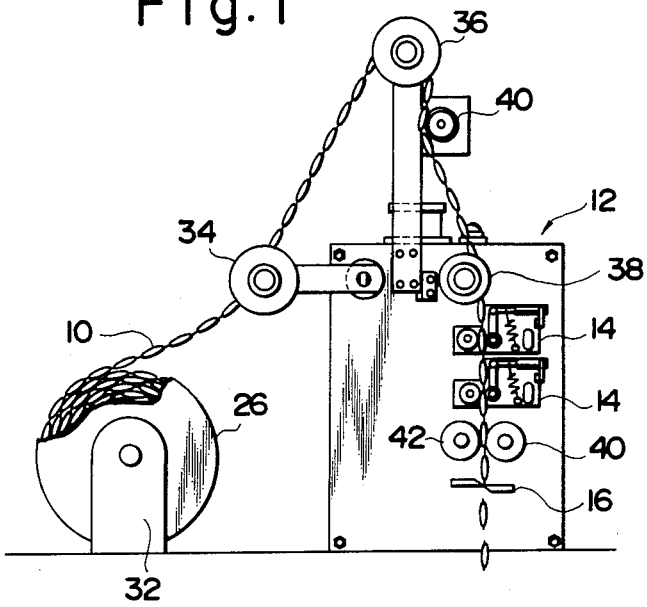
FIG. 1 is a front elevational view of a package severing apparatus embodying the present invention for severing successive packages of deoxidizing agent from a continuous package train.

When the packages of the package train are put into containers of goods to be deoxidized, e.g., foodstuffs, the package train 10 coiled on the bobbin 26 is taken out of the sack 30 and the bobbin is mounted rotatably on a bracket 32 provided on the inlet side of the automatic severing apparatus 12 as shown in FIG. 1, so that the leading end of the package train 10 is fed into the automatic severing apparatus 12.

Since the package train 10 according to the invention is stored in the form of a coil on the bobbin 26, a fold line is not formed anywhere in the package train 10, so that the thickness sensors 14 of the automatic severing apparatus 12 can correctly detect the position of the connecting webs 24. The deterioration of the detecting precision is avoided also in the case where a photoelectric mark sensor is used in place of the thickness sensors 14.

The package train 10 is subjected to the ambient air after it's mounted on the automatic severing apparatus 12. However, since the package train 10 is coiled in layers, only the outermost layer is contacted by air, so that no substantial reduction in the oxygen absorption capacity takes place in other layers. The reduction in the oxygen absorption capacity is small also in the outermost layer of the coil, because this layer is contacted by the ambient air only at its one side. Thus, the coiling of the package train 10 on the bobbin 26 is preferably conducted in such a manner as to expel air from the spaces between adjacent layers and to prevent air from coming into such spaces, while avoiding any unfavorable physical effect on the package train 10. It will be seen that the conventional package train 10 shown in FIG. 2 cannot effectively prevent air from coming into the spaces between adjacent layers of the stack.

In the package train of the present invention, the core 28 of the bobbin 26 is preferably made of a material which exhibits only a small permeability to air, because a material having large air permeability will undesirably cause the packages on the core 28 to absorb oxygen through the material of the core 28. Examples of materials suitable for use as the material of the core 28 are a thick paper sheet or a plastic such as polyethylene, polypropylene or the like. More specifically, a material having oxygen permeability on the order of 100,000 $cc/m^2$ 24 Hr. atm (under atmospheric pressure for the duration of 24 hours) or less is preferably used as the material of the core 28.

If the circumferential length of the coiled package train 10 is too small, each package 20 tends to exhibit a buckling tendency even after the package train is uncoiled. Such a buckling tendency is liable to cause troubles such as cutting failure. Therefore, the core 28 of the bobbin 26 should have a circumferential length which is preferably at least twice, more preferably three times that of the length of each package 20 as measured in the coiling direction.

Figure 2:
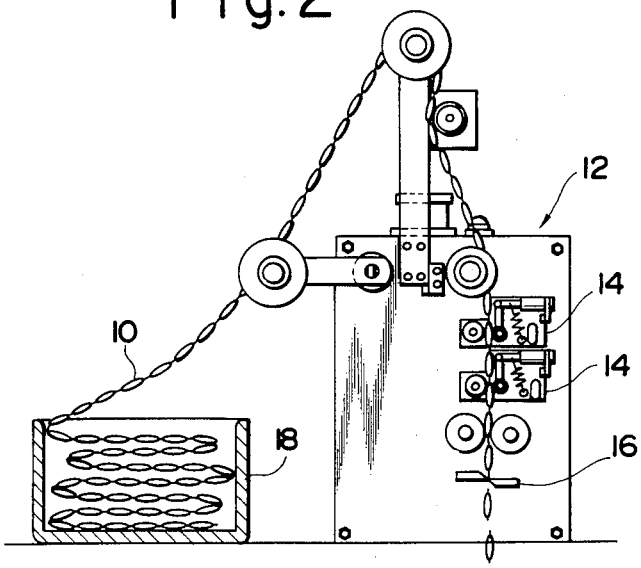
FIG. 2 is a front elevational view of a conventional package severing apparatus.

The severing apparatus 12 may have a construction which is substantially the same as that of the known apparatus shown in FIG. 2. Namely the severing apparatus can have thickness sensors 14, a cutter 16 which operates in accordance with the result of thickness measurement conducted by the thickness sensors 14, guide rollers 34, 36, 38, a vibrator 40 and feed rollers 42, 44.

According to the present invention, the continuous package train 10 is coiled on a bobbin, so that no substantial reduction in the oxygen absorption capacity, which may otherwise be caused due to contact with the ambient air, is encountered regardless of whether the deoxidizing agent is of an additive reaction type which exhibits oxygen absorbability with external supply of moisture or of a self-reaction type which absorbs oxygen when merely placed in the air. This provision also enables the cutter 16 of the automatic severing apparatus to cut the package train 10 precisely at the connecting webs 24.

Some of the known deoxidizing agents used hitherto exhibit large reduction rates of oxygen absorption capacity which is 5% or higher when left in the air at 25° C. and 50–60% humidity. A package train of such deoxidizing agents having a large reduction rate of oxygen absorption capacity can contain only a small number of packages, so that it is materially impossible to use an automatic severing apparatus. In contrast, the package train in accordance with the present invention can have a large number of packages, so that it can be conveniently and efficiently handled by an automatic severing apparatus. The possibility of production of package trains having a large number of packages is advantageous from all points of view.

Experimental Data:

Experimental data relating to the package train in accordance with the present invention will be described hereinunder.

A package train was prepared by using, as the packaging material, a porous polyethyleneterephthalate film of 12μ thickness and 100 mm width, providing a series of packages each being 50 mm long and 50 mm wide and charged with 3.0 g of a deoxidizing agent containing iron powder. The thus formed package train was coiled in good order on a collared bobbin having a core made of a thick paper sheet and having an inside diameter of 3 inches and a thickness of 7 mm. The package train had 2,000 pieces of deoxidizing agent packages connected in series. Immediately after the preparation, the package train was placed in a sack made of drawn nylon/polyethylene coated with vinylidene chloride. The sack was deaerated and then sealed.

As a comparison example, a similar deoxidizing agent package train of known folded type was prepared. This package train of the comparison example had 2,000 pieces of packages which were folded at every 8 packages, and was sealed in a sack of the same material as that used for the package train of the invention.

These two types of package train were taken out of the sacks and were subjected to a test severing operation which was conducted with an automatic severing apparatus (Model NR4 produced by Asahi Kinzoku K.K.). The test operation was conducted at a severing rate of 20 packages per minute. The oxygen absorption capacity was measured on the first package, the 1,000 th package and the 2,000 th package for each type of package train. The measurement of the oxygen absorption capacity was conducted by sealing the sample packages in sacks of the same material as above together with 3 liters of air, preserving the sample packages in the sealed state at 25° C. for seven days, and then measuring the oxygen concentration as the oxygen absorption.

The results of the test are shown in Tables 1 and 2.

TABLE 1

| | Oxygen absorption (7 days after: ml) | | |
|---|---|---|---|
| | 1st package | 1,000th package | 2,000th package |
| Packages of invention | 275 | 270 | 260 |
| Comparison Example | 241 | 201 | 125 |

TABLE 2

| | Number of times of severing failure |
|---|---|
| Packages of invention | 0 |
| Comparison example | 3 |

As will be seen from Table 2, no severing failure was observed when the package train of the invention was handled by the automatic severing apparatus, whereas inferior severing was experienced with the package train of the comparison example, due to the presence of folds in the package train. In fact, severing failure was observed three times during the severing operation. It will be understood also that, while the package train in accordance with the present invention showed no substantial reduction in the oxygen absorption capacity, a significant reduction was observed with the package train of the comparison example, and the 2,000 th package of the comparison example was materially unusable.

As has been described, according to the invention, it is possible to obtain a train of package having a large number of packages containing a deoxidizing agent, without any risk of reduction in the oxygen absorption capacity which inevitably takes place in the conventional package train before fed to an automatic severing apparatus. In addition, the package train of the present invention enables the automatic severing apparatus to cut the package train precisely at the connecting webs at which adjacent packages are connected, so that products such as foodstuffs sealed together with a deoxidizing agent package can be produced at a high yield.

Although the invention has been described through its preferred form, it is to be noted that the described embodiment is only illustrative and various changes and modifications may be imparted thereto without departing from the scope of the invention which is limited solely by the appended claims.

What is claimed is:

1. A continuous package train comprising a plurality of packages connected in series, each package charged with a deoxidizing agent, including:

a belt-like package train having a plurality of said packages connected in series in at least one direction; and a core on which said belt-like package train is coiled in layers around said core in such a manner that packages in one layer overlap packages in an adjacent layer and substantially prevent air from entering between adjacent layers of said packages, said belt-like package train having at least one surface layer formed from a plastic film including polyethylene terephthalate, polyamide, polypropylene, or cellophane, said deoxidizing agent exhibiting reduction rates of oxygen adsorption capacity of at least 5% when exposed to an atmosphere of 50 to 60% relative humidity at 25 degrees C. and is at least one member selected from the group consisting of ascorbic acid, a salt of ascorbic acid, and a metal powder, and said core having a circumferential length which is at least twice as large as the length of one of said packages as measured in the winding direction and is formed from a material having an oxygen permeability of about 100,000 cc/m$^2$ Hr. atm. or less.

2. A continuous package train according to claim 1, wherein said body of said package train has thick-walled sack portions constituting said packages charged with said deoxidizing agent and sealed connecting webs having a thickness smaller than that of said sack portions, said sack portions and said sealed connecting webs being arranged alternatingly in the longitudinal direction of said body of said package train.

3. A package train according to claim 1 wherein said deoxidizing agent contains iron powder.

* * * * *